US008507815B2

(12) United States Patent
Aletti

(10) Patent No.: US 8,507,815 B2
(45) Date of Patent: Aug. 13, 2013

(54) APPARATUS FOR THE CONTROL AND/OR DISTRIBUTION OF ELECTRIC POWER COMPRISING A PROTECTIVE ANTI-DUST DEVICE

(75) Inventor: Tiziano Aletti, Inarzo (IT)

(73) Assignee: BTICINO S.p.A., Milan (IT)

( * ) Notice: Subject to any disclaimer, the term of this patent is extended or adjusted under 35 U.S.C. 154(b) by 0 days.

(21) Appl. No.: 13/521,748

(22) PCT Filed: Feb. 24, 2011

(86) PCT No.: PCT/IT2011/000052

§ 371 (c)(1),
(2), (4) Date: Dec. 20, 2012

(87) PCT Pub. No.: WO2011/121625

PCT Pub. Date: Oct. 6, 2011

(65) Prior Publication Data

US 2013/0134019 A1 May 30, 2013

(30) Foreign Application Priority Data

Mar. 30, 2010 (IT) ..... RM2010A0145

(51) Int. Cl.
*H01H 9/04* (2006.01)

(52) U.S. Cl.
USPC ..... 200/302.1

(58) Field of Classification Search
USPC ..... 200/302.1, 293, 300, 51.14, 61.08, 200/83 R, 83 B, 512, 308, 310; 439/661
See application file for complete search history.

(56) References Cited

U.S. PATENT DOCUMENTS

| | | | | |
|---|---|---|---|---|
| 3,243,539 | A * | 3/1966 | Mazzeo | 200/83 B |
| 4,532,390 | A * | 7/1985 | Gallone | 200/83 B |
| 8,324,518 | B2 * | 12/2012 | Furrer | 200/61.62 |

FOREIGN PATENT DOCUMENTS

| | | |
|---|---|---|
| DE | 2557330 | 7/1977 |
| DE | 102007005509 | 8/2007 |
| DE | 102006056007 | 5/2008 |
| GB | 2196792 | 5/1988 |
| WO | 2007/043882 | 4/2007 |
| WO | 2010/006867 | 1/2010 |

* cited by examiner

*Primary Examiner* — Edwin A. Leon
(74) *Attorney, Agent, or Firm* — Robert E. Alderson, Jr.

(57) ABSTRACT

Devices for the control and/or distribution of electric power having protective features against dust and other particles are provided.

13 Claims, 3 Drawing Sheets

APPARATUS FOR THE CONTROL AND/OR DISTRIBUTION OF ELECTRIC POWER COMPRISING A PROTECTIVE ANTI-DUST DEVICE

CROSS-REFERENCE TO RELATED APPLICATIONS

This application is a National Phase Application of PCT International Application No. PCT/IT2011/000052, International Filing Date, 24 Feb. 2011, claiming priority to Italian Patent Application No. RM2010A000145, filed 30 Mar. 2010, both of which are hereby incorporated by reference in their entirety.

FIELD OF THE INVENTION

The present description refers to the technical field of electrical installations and, more in particular, it concerns an electrical apparatus for the control and/or distribution of electric power comprising a protective device against the intrusion of dust and similar as defined in the preamble of the first claim.

BACKGROUND OF THE INVENTION

As known, electrical apparatuses for the control and/or distribution of electric power, such as for example circuit breakers, comprise a box-shaped body made from electrically insulating material having a bottom wall and side walls delimiting an inner space for housing electromechanical mechanisms of the electrical apparatus. At a front face of the box-shaped body a manual actuation device is generally provided, such as for example a lever, a rocker arm or a button. In some of the aforementioned electrical apparatuses the bottom wall of the box-shaped body is equipped with an access opening to the inner space intended for being traversed by a fitting device, like for example an LED backlighting device, which can be operatively coupled to the electrical apparatus. In some of the electrical apparatuses of the prior art the access opening is already foreseen and left open during the manufacturing of the electrical apparatus. The access opening represents an area of undesired intrusion of dust and similar particles, such as for example grains of sand and particles of construction material, inside the box-shaped body.

In order to reduce the aforementioned drawback given by the undesired intrusion of dust and similar through the access opening, in some electrical apparatuses the access opening is practically obtained only during installation of the electrical apparatus, since the opening is initially occluded by a removable closing wall generally at least partially delimited and surrounded by pre-fractures/weakenings foreseen so as to facilitate its removal. The removal operation of the closing wall complicates the installation operations, moreover there is the risk that during the removal operation the closing wall itself or undesired particles that temporarily stick to the tool used for the removal fall back inside the housing space through the access opening thus nullifying the function of the removable closing wall.

The undesired intrusion of dust or particles in electrical apparatuses as described in patent applications WO 2006/106554 and WO 2010/0006867 is particularly problematic since it can determine jamming of the control mechanism. In other types of electrical apparatuses such an undesired intrusion is in any case problematic since the dust or the particles can contaminate the electromechanical or electrical components housed inside the housing space, causing faults, a degradation of performance or temporary malfunctioning.

Patent application WO 2007/043882 describes an electrical apparatus comprising a protective device comprising a tearable membrane. It is considered that such a membrane is ineffective in the case in which in the body of the apparatus further openings are foreseen, with respect to the one occluded by the membrane itself, suitable for allowing access to the connection terminals in the form of screw clamps. Moreover, the aforementioned tearable membrane potentially has the drawback of producing, in the tearing operation, fragments that can contaminate the inner space of the electrical apparatus.

It is felt necessary to have an apparatus available that is improved in relation to at least one or two aforementioned drawbacks with reference to patent application WO 2007/043882.

SUMMARY OF THE INVENTION

Such a requirement is satisfied with an apparatus for the control and/or distribution of electric power as described herein and in the claims.

The invention shall become clearer from the following detailed description of a particular embodiment given as an example and, therefore, in no way limiting, with reference to the attached drawings, in which:

DETAILED DESCRIPTION

Figure 1:
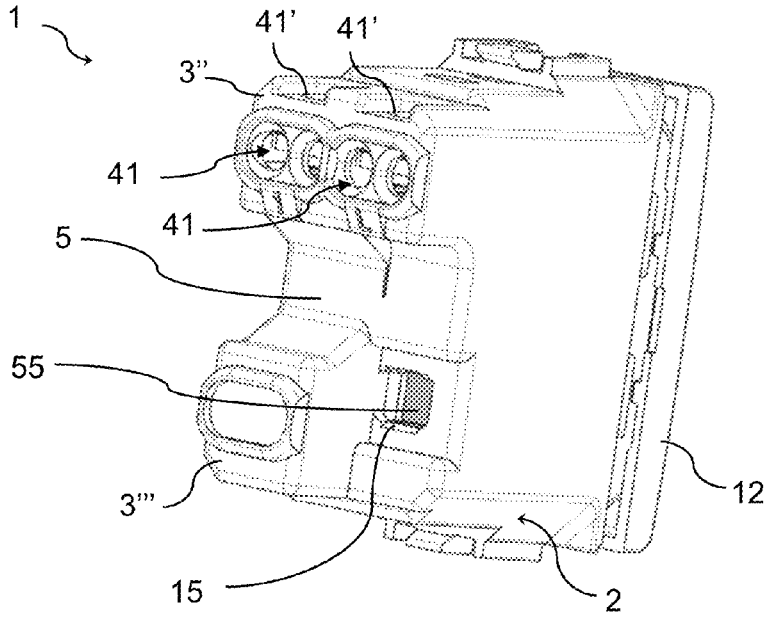
FIG. 1 is a perspective view of one embodiment of an apparatus for the control and/or distribution of electric power, in which the rear face of the apparatus is visible.

In the figures, equivalent or similar elements shall be indicated with the same reference numerals.

With reference to the attached figures, these show a non limiting embodiment of an apparatus for the control and/or distribution of electric power, wholly indicated with reference numeral 1 and in the rest of the description more simply indicated with electrical apparatus 1. In the particular example represented in the figures and that shall be described hereafter, the electrical apparatus 1 is a modular push button circuit breaker, i.e. intended to be installed in a support frame to be mounted on a wall alongside other circuit breakers of the same type or in general alongside other modular electrical apparatuses, like for example power sockets.

In an alternative embodiment, the electrical apparatus 1 is any modular electrical apparatus for civil electrical installations, such as for example and not for limiting purposes a power socket, a trimmer, circuit breaker with pivoting key, a deviator circuit breaker, etc.

In accordance with possible further embodiments, the electrical apparatus 1 is any other apparatus for the control and/or distribution of electric power, such as for example an electrical apparatus that can be installed on a DIN rail (for example a so called "miniature circuit breaker") or a so called molded case circuit breaker intended to be installed in an electrical panel.

From now on we shall refer, without for this reason introducing any limitation, to the case in which the electrical apparatus 1 is a modular push button circuit breaker, like in the example represented in the figures.

The push button circuit breaker 1 comprises a supporting structure 2 made from electrically insulating material, for example plastic and preferably from polycarbonate. The supporting structure 2, preferably and not limitingly, approximately has the shape of a parallelepiped with four side walls 6-9 and a bottom wall 5.

The supporting structure 2, between the side walls 6-9 and the bottom wall 5 identifies an inner space 3, which communicates through a front opening 23 with outside the supporting structure 2.

The push button circuit breaker 1 also includes a diaphragm 28. The diaphragm 28 divides the inner space 8 into a first 3' and at least one further chamber 3".

The diaphragm 28 is made from a piece that is separate from the supporting structure 2 and is subsequently coupled to the latter. For example, the diaphragm 28 is made from polycarbonate.

In the inner space 3 of the supporting structure 2 and in particular in the further chamber 3", at least one electrical connection terminal 41 is housed comprising a screw clamp. In FIG. 1 in particular two electrical connection terminals 41 of the aforementioned type are indicated of which one is visible in FIGS. 3-5. The screws of the aforementioned terminals can be accessed through the openings 41' obtained in the walls of the supporting structure 2.

Figure 3:
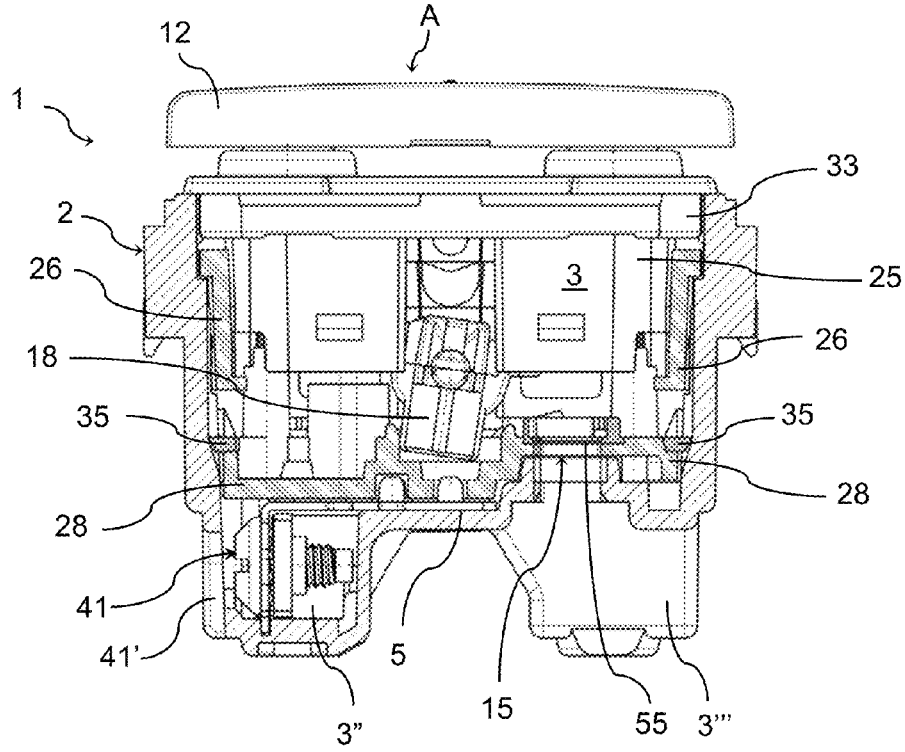
FIG. 3 is a side plan view partially in section of the apparatus of FIG. 1 in which the apparatus has been sectioned along the axis X-X of FIG. 2.
Figure 4:
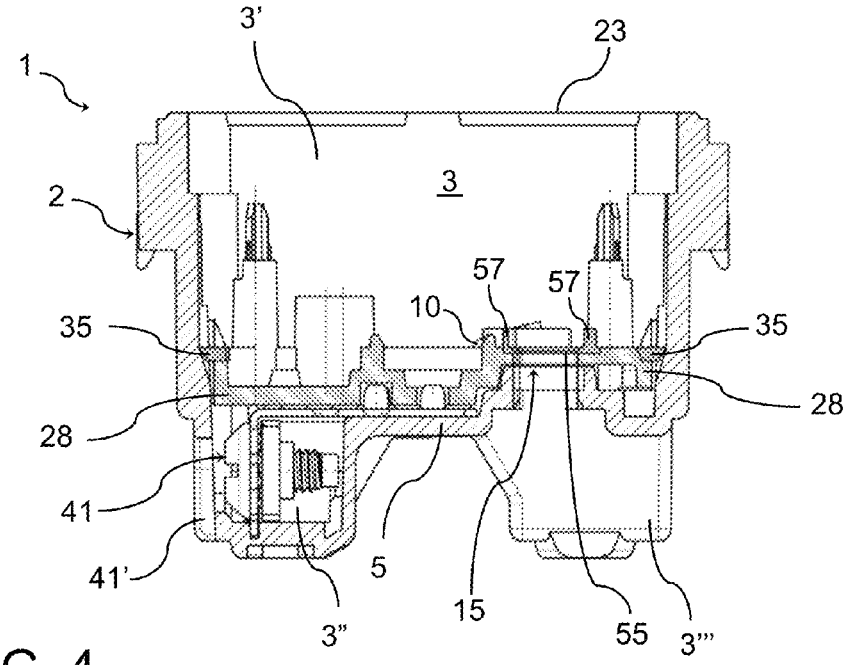
FIG. 4 is a similar view to that represented in FIG. 3 in which some parts of the apparatus have been removed.
Figure 5:
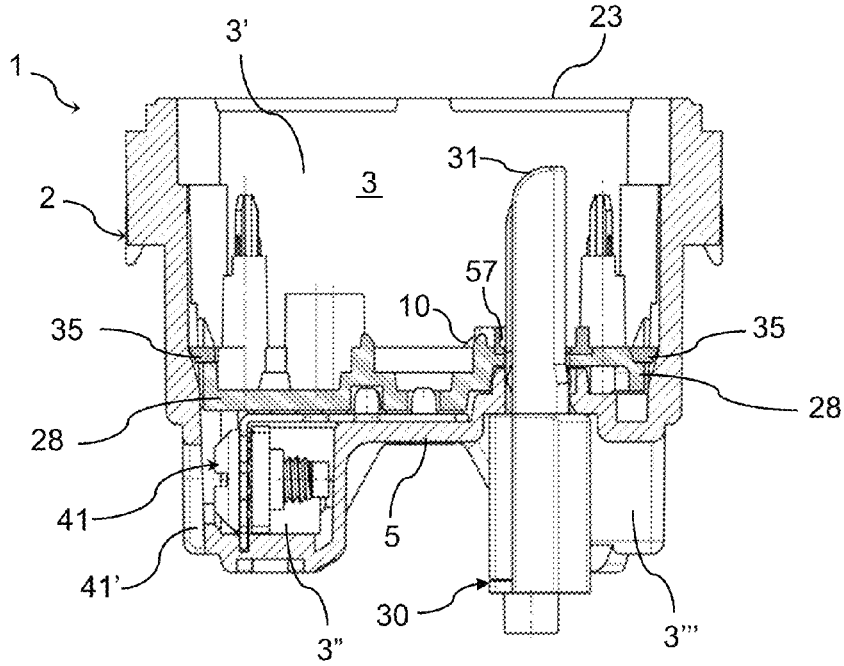
FIG. 5 is a similar view to that represented in FIG. 4 in which a backlighting fitting is operatively coupled to the apparatus.

In the example described, the inner space 3 also comprises the further chamber 3''', represented in FIGS. 3-5, which is a chamber intended for housing a possible further electrical connection terminal, in the case in which the electrical apparatus is of the type requiring a third connection, like for example in the case in which the electrical apparatus is a deviator circuit breaker.

In the example described, the push button circuit breaker 1 also comprises a switching member 10 that is suitable for establishing/interrupting electrical connections, for example between fixed contact elements, which in the particular example is a rotary metal jumper 10 having at least one mobile contact element.

In the example described, the rotary jumper 10 is a rocker arm with a rounded central profile and it is located in the inner space 8 of the supporting structure 2 and in particular in the first chamber 3'. The jumper 10 is such as to be able to be moved to rotate on a pivot around its central resting part so as to establish/interrupt electrical connections between the electrical terminals 41 or better between the fixed contact elements connected to said electrical connection terminals 41.

The push button circuit breaker 1 includes, moreover, an actuation mechanism coupled to the supporting structure 2. The actuation mechanism includes a button 25 and mechanical coupling elements 26 suitable for coupling the button 25 to the supporting structure 2 so as to fixedly connect the button 25 to the supporting structure 2. In accordance with one embodiment, the mechanical coupling elements comprise a holding and guiding frame 26 made in accordance with the teachings of the international patent application WO 2006/106554.

In accordance with one embodiment, the actuation mechanism 24 preferably comprises a rotary control element 18 that is housed in the first chamber 3' and that is suitable for moving the jumper 10 made in accordance with what has been described in European patent EP 1 584 096 and/or in the international patent application WO 2006/106554.

The push button circuit breaker 1 also comprises a key, or counter-button, that can be fixed to the button 25 for the manual actuation of the button and that is not visible in the figures since in the example it is covered by a key cover 12 which can be coupled to the key and essentially has a function of aesthetic finishing.

In accordance with a preferred and not limiting embodiment, the push button circuit breaker 1 comprises a protective anti-jamming device 33, comprising a protective cap 33 suitable for occluding the front opening 23 and for example made in accordance with the teachings of the international patent application WO 2010/006867.

With reference to FIG. 1, it can be observed how one of the confinement walls 5-9 of the supporting structure 2, and in the particular non limiting example represented, the bottom wall 5, i.e. the wall opposite the front face of the push button circuit breaker 1, comprises an access opening 15 to the inner space 3. For the purpose of the present description by bottom wall 5 or rear wall 5 we mean a wall opposite the front face of the push button circuit breaker 1. The front face of the push button circuit breaker 1 (face A in FIG. 3) is practically the face intended during normal use to face towards a worker that visually or through touching interacts with the push button circuit breaker 1. This definition can be generalised to any further embodiment of an electrical apparatus 1 indicated above.

The access opening 15 is intended to be traversed by a fitting device 30 (FIG. 5) which can operatively be coupled to the push button circuit breaker 1 through engagement through the opening 15. The aforementioned engagement is for example an axial engagement, where by axial direction we mean a direction that is perpendicular to the plane in which the access opening 15 lies. In accordance with one embodiment, the aforementioned fitting device 30 is an LED backlighting device. In alternative embodiments, the aforementioned fitting device 30 is any device that can be coupled with the access opening 15, for example a micro-switch for controlling or monitoring the state of the electrical apparatus 1, an electrical connection device, such as for example a plug, a rigid conductor, etc.

Advantageously, the electrical apparatus 1 comprises a protective device 35, 55 against the intrusion of dust and similar, or "protective anti-dust device", coupled to the supporting structure 2.

The protective anti-dust device 35, 55 comprises a tearable membrane 55 occluding the access opening 15 and intended for being torn and/or traversed by the fitting or connecting device 30 which can be operatively coupled to the electrical apparatus 1 by engagement with the access opening 15. Preferably the tearable membrane 55 is made from relatively more elastic material, for example made from rubber material, with respect to the material from which the supporting structure 2 is made.

Figure 2:
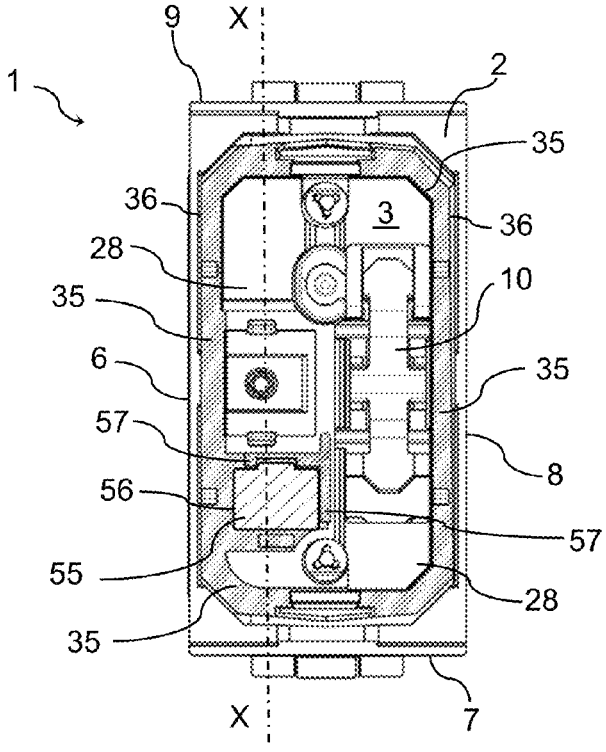
FIG. 2 is a plan view of one part of the apparatus of FIG. 1.

A particular non limiting embodiment of a protective anti-dust device 35, 55 is clearly visible in FIG. 2 in which it is highlighted with a broken line. In such a figure, the tearable membrane 55 has been indicated with a thinner broken line. The tearable membrane 55 is housed in the inner space 3 delimited by the supporting structure 2.

In accordance with one embodiment, the tearable membrane 55 is surrounded by an outer edge 56 and faces the access opening 15.

In accordance with a possible embodiment, the tearable membrane 55 is made from thermoplastic polyurethane.

Advantageously, the tearable membrane 55 has a relatively small thickness, for example comprised between 0.1 mm and 0.3 mm and preferably equal to 0.2 mm. In accordance with one embodiment, the tearable membrane 55 with relatively small thickness is surrounded by a supporting framework 57, made in a single piece with the tearable membrane 55 and with the same material and having, at least in some sections, a greater thickness with respect to the thickness of the tearable membrane 55. Such sections make it possible to keep the fitting 30 in its position once it has been coupled to the electrical apparatus 1.

The tearable membrane 55 is coupled to the supporting structure 2 through the diaphragm 28. In particular, the tearable membrane 55 is directly fixed to the diaphragm 28 housed in the inner space 3. In accordance with a particularly advantageous embodiment, the tearable membrane 55 and the diaphragm 28 form a single piece made through bi-material moulding, in which the diaphragm 28 is preferably made from polycarbonate and the tearable membrane 55 is made from polyurethane.

In accordance with a further non limiting embodiment, the protective device 35, 55 comprises an annular seal 35 that surrounds the diaphragm 28 and the tearable membrane 55 represents an inner appendix of the annular seal 35. Preferably, the annular seal 35 is made in a single piece with the tearable membrane 55 (being for example both made from bi-material moulding with the diaphragm 28). Preferably, the annular seal 35 has a greater thickness than the tearable membrane 55 and more preferably, the supporting framework 57 of the tearable membrane 55, if foreseen, represents an inner appendix of the annular seal 35. Advantageously, the annular seal 35 and the tearable membrane 55 effectively insulate the first chamber 3' of the inner space 3 from at least one further inner chamber 3".

Preferably, the annular seal 35 has an outer peripheral edge 36 (FIG. 2) that, throughout its length, is against the walls 6-9 of the supporting structure 9 orthogonal to a plane in which the tearable membrane 55 lies. In the particular example represented in the figures, the annular seal 35 is fixed to an edge portion of the diaphragm 28 to project beyond the diaphragm 28. Preferably, the cross section of the annular seal 35 is essentially shaped like a trapezium.

Figure 6:
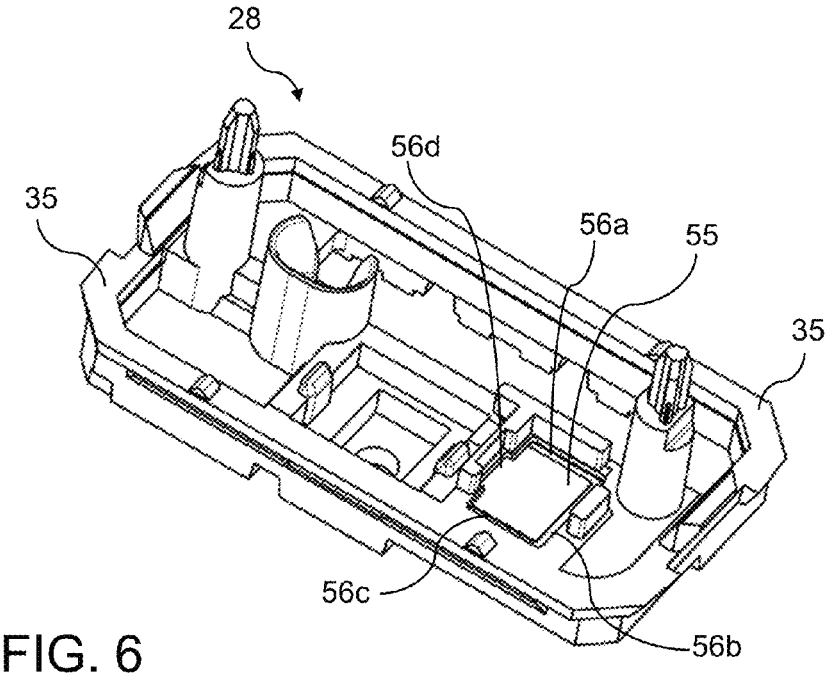
FIG. 6 is a perspective view representing a diaphragm of the apparatus of FIG. 1.

With reference to FIG. 6, in accordance with one embodiment, the edge 56 that delimits the membrane 55 comprises a portion 56*a*, 56*b*, 56*c* with a relatively small thickness with respect to a remaining edge portion 56*d*. Said thickness is meant as measured with respect to an axis that is perpendicular to a face of the membrane 55. In such a way, the tearing of the membrane 55 is controlled, i.e. guided, so that the edge 56 of the membrane 55 tears along the portion with a relatively small thickness 56*a*, 56*b*, 56*c* and remains attached to the remaining portion 56*d*, advantageously avoiding that the torn membrane or fragments thereof completely separate from the diaphragm 28 falling back into the inner space 8 and in particular into the first chamber 3'. In the aforementioned embodiment the membrane 55 is therefore a membrane with controlled tearing.

Now we shall briefly explain how an electrical apparatus 1 as described above operates. The electrical apparatus 1 is initially manufactured and made available in the configuration represented in figures from 1 to 4, in which the tearable membrane 55 occludes the access opening 15.

During transportation and during storage the electrical apparatus 1 is therefore protected against undesired intrusion of dust and similar through the access opening 15.

During installation, for example in an electrical home installation, a worker who desires to couple a fitting or connection device to the electrical apparatus 1, for example an LED backlighting device 30 (FIG. 5), pushes with an end portion 31 of the device 30 against the membrane 55 to forcibly couple such a device with the access opening 15. At a certain point, the pressure applied causes the tearable membrane to break, and the end portion 31 of the device 30 is free to traverse through the access opening 15 so as to make it possible to establish an operative coupling between the electrical apparatus 1 and the device 30. Moreover, it is possible to foresee that the edge of the torn membrane, or the supporting framework 57 of said membrane 55, push, after the engagement of the device 30 with the access opening 15, on a section of the outer walls of the device 30, ensuring a certain protection and seal even during the normal use of the electrical apparatus 1, i.e. after its installation and during its normal operation in the power grid it is installed in.

Foreseeing the annular seal 35, represents a possible optional provision, so as to ensure a further protection from dust and similar, for example by isolating a part of inner space 3, i.e. the first chamber 3', to protect said isolated part from a possible intrusion of dust and similar through the access opening of the terminals 41.

From the description just made it is possible to understand how an electrical apparatus of the type described above fully achieves the set purposes. Indeed it should be observed how, advantageously, by foreseeing a protective anti-dust device 35,55 of the type described above it is possible to avoid undesired intrusion of dust particles and similar through the access opening 15 and therefore to solve or substantially limit the drawback of electrical apparatuses described above with reference to the prior art.

Of course, a man skilled in the art, with the purpose of satisfying contingent and specific requirements, may carry out numerous modifications and variants to the electrical apparatus described above, all covered moreover by the scope of protection of the invention, as defined by the following claims.

For example, although an electrical apparatus has been described in which the access opening 15 is made in the rear wall 5, which commonly occurs in electrical modular apparatuses, it is possible to foresee that in other types of electrical apparatuses the aforementioned access opening is defined in a confinement wall that is different with respect to the rear wall 5.

It should also be observed that, although it is particularly advantageous to tear the membrane directly through the fitting or connecting device 30 through a forced coupling thereof, in a currently less preferred embodiment it is also possible to use a tool to tear, or pre-tear, the membrane before the engagement of the device 30.

The invention claimed is:

1. An apparatus for the control and/or distribution of electric power comprising:

a generally box-shaped supporting structure delimiting an inner space, the supporting structure comprising confinement walls of the inner space in at least one of which an access opening to the inner space is defined;

a switching member suitable for establishing/interrupting electrical connections, said switching member being housed in the inner space;

at least one electrical connection terminal;

a protective device against the intrusion of dust and similar stably coupled to the supporting structure, comprising a tearable membrane occluding the access opening and intended for being torn and/or traversed by a fitting or connecting device which can be coupled to the apparatus by engagement with said opening;

characterised in that the electrical connection terminal comprises a screw clamp, the apparatus comprising a diaphragm housed in the inner space and such as to divide the inner space into a first and at least one further chamber, the tearable membrane being fixed to the diaphragm, wherein the first chamber and the further chamber house respectively said switching member and said screw clamp.

2. The apparatus of claim 1, wherein said membrane is delimited by an edge with a variable thickness so as to allow controlled tearing of the membrane.

3. The apparatus of claim 2, wherein the edge that delimits the membrane comprises an edge portion with a thickness that is relatively smaller than a remaining edge portion.

4. The apparatus of claim 1, wherein the tearable membrane is made from thermoplastic polyurethane.

5. The apparatus of claim 1, wherein the tearable membrane has a thickness of between 0.1 mm and 0.3 mm.

6. The apparatus of claim 1, wherein said at least one confinement wall is a bottom wall of the inner space opposite to a front face (A) of the apparatus.

7. The apparatus of claim 1, wherein the tearable membrane and the diaphragm form a single piece made through bi-material moulding.

8. The apparatus of claim 1, wherein the protective device comprises an annular seal that surrounds the diaphragm and wherein the tearable membrane is an inner appendix of the annular seal.

9. The apparatus of claim 8, wherein the annular seal has an outer peripheral edge which, throughout its length, bears against walls of the supporting structure orthogonal to a plane in which the tearable membrane lies.

10. The apparatus of claim 8, wherein the annular seal is fixed to an edge portion of the diaphragm to project beyond said diaphragm.

11. The apparatus of claim 1, wherein said apparatus is a modular electrical apparatus.

12. A group of parts comprising the apparatus of claim 1 and a fitting or connecting device having an end portion adapted to tear and/or pass through the membrane upon forced coupling of said end portion in said access opening.

13. The group of parts of claim 12, wherein said fitting or connecting device is a LED backlighting device.

* * * * *